US005205473A

United States Patent [19]

Coffin, Sr.

[11] Patent Number: 5,205,473

[45] Date of Patent: Apr. 27, 1993

[54] RECYCLABLE CORRUGATED BEVERAGE CONTAINER AND HOLDER

[75] Inventor: David W. Coffin, Sr., Fayetteville, N.Y.

[73] Assignee: Design By Us Company, Philadelphia, Pa.

[21] Appl. No.: 854,425

[22] Filed: Mar. 19, 1992

[51] Int. Cl.[5] ..... B65D 3/28

[52] U.S. Cl. ..... 229/1.5 B; 206/813; 220/441; 220/DIG. 30; 229/1.5 H; 229/DIG. 2; 493/296; 493/907

[58] Field of Search ..... 229/1.5 B, 1.5 H, 4.5, 229/DIG. 2; 220/441, 671, 737-739, DIG. 30; 493/287, 296, 907, 908; 209/8, 47, 215; 206/813

[56] References Cited

U.S. PATENT DOCUMENTS

| | | | |
|---|---|---|---|
| 1,732,322 | 10/1929 | Wilson et al. | 220/DIG. 30 |
| 1,771,765 | 7/1930 | Benson | 229/4.5 |
| 2,266,828 | 12/1941 | Sykes | 229/1.5 B |
| 2,300,473 | 11/1942 | Winkle | 229/4.5 |
| 2,501,815 | 3/1950 | Hamm . | |
| 2,617,549 | 11/1952 | Egger . | |
| 2,641,402 | 6/1953 | Bruun | 229/4.5 |
| 2,661,889 | 12/1953 | Phinney | 229/4.5 |
| 2,969,901 | 1/1961 | Behrens | 229/1.5 B |
| 3,237,834 | 3/1966 | Davis et al. | 229/1.5 B |
| 3,779,157 | 12/1973 | Ross, Jr. et al. | 53/527 |
| 3,785,254 | 1/1974 | Mann . | |
| 3,890,762 | 6/1975 | Ernst et al. . | |
| 3,908,523 | 9/1975 | Shikaya | 229/1.5 B |
| 4,080,880 | 3/1978 | Shikay | 493/296 |
| 4,146,660 | 3/1979 | Hall et al. . | |
| 4,176,054 | 11/1979 | Kelley | 209/8 |
| 5,009,326 | 4/1991 | Reaves et al. . | |
| 5,092,485 | 3/1992 | Lee | 229/1.5 B |

OTHER PUBLICATIONS

"The Wiley Encyclopedia of Packaging Technology", John Wiley & Sons, pp. 66-69, 1986.

*Primary Examiner*—Gary E. Elkins
*Attorney, Agent, or Firm*—Synnestvedt & Lechner

[57] ABSTRACT

Corrugated beverage containers and holders are which employ recyclable materials, but provide fluting structures for containing insulating air. These products are easy to hold and have a lesser impact on the environment than polystyrene containers.

18 Claims, 8 Drawing Sheets

RECYCLABLE CORRUGATED BEVERAGE CONTAINER AND HOLDER

FIELD OF THE INVENTION

This invention relates to insulating containers, and especially those which are recyclable and made of cellulosic materials.

BACKGROUND OF THE INVENTION

Hot beverage containers have traditionally been constructed of two materials: wax-coated paper and polystyrene. Although both products have received wide spread implementation by fast food restaurants and consumers, they each have their own specialized drawbacks which have yet to be overcome.

Polystyrene is an excellent insulator, and because of its unique moldability, can be formed into a myriad of different shapes and sizes. Unfortunately, however, polystyrene is neither easily recyclable nor biodegradable, and must be disposed in a sanitary landfill. Landfills have become extremely expensive to use and are rapidly being filled to capacity. Polystyrene can also be incinerated, but this disposal method requires a significant amount of environmental safeguards because of the toxic fumes polystyrene emits while burning.

Wax-covered paper products have been used in beverage containers for years, and have increasingly been replacing polystyrene as the material of choice. This material is generally recyclable, and is more readily degraded by environmental exposure than polystyrene. Unfortunately, because of its low insulation qualities, containers made of this material are very difficult to handle.

Accordingly, there is a need for a food and beverage container which provides adequate insulation for comfortable handling, but which is generally friendly to the environment. Such a container must be inexpensive, so as to be a cost effective substitute for either paper or polystyrene alternatives.

SUMMARY OF THE INVENTION

This invention provides recyclable, corrugated containers and container holders which can be made from existing cellulosic materials, such as paper. The preferred recyclable, corrugated hot beverage container includes a lip and an internal cavity for containing a hot or cold medium. The container includes fluting means, such as fluting adhesively attached to one or more liners, for thermally spacing the hands of the user from the harsh temperatures of the contents of the container.

In the preferred holders of this invention, a corrugated tubular member is provided having at least a first opening for receiving and retaining a cup, or the like. The tubular member's corrugation, like that for the container above, includes fluting means for providing insulating air pockets. The holder can also be fashioned to be collapsible about two or more pivot points for flat storage.

Accordingly, the deficiencies of both paper and polystyrene are overcome at a minimum expense. The containers of this invention can be used for comfortably holding a variety of beverages, such as hot chocolate, soup, or coffee. The provided holders can be used in conjunction with paper cups, aluminum cans, or other beverage containers, without the discomfort associated with condensation and extreme temperatures.

BRIEF DESCRIPTION OF THE DRAWINGS

The accompanying drawings illustrate preferred embodiments of the invention according to the practical application of the principles thereof, and in which:

FIGS. 6*a* and 6*b*: are enlarged partial views of preferred fluting structures, in which FIG. 6*a* illustrates a sinuous fluting adhered to a single liner, and FIG. 6*b* illustrates a sinuous fluting adhered to an inner and outer liner;

FIGS. 7*a* and 7*b*: are enlarged partial views of an alternative fluting structure, in which FIG. 7*a* illustrates an angular flute adhered to a single lining, and FIG. 7*b* illustrates an angular flute adhered to an inner and outer liner;

DETAILED DESCRIPTION OF THE INVENTION

Figure 2:
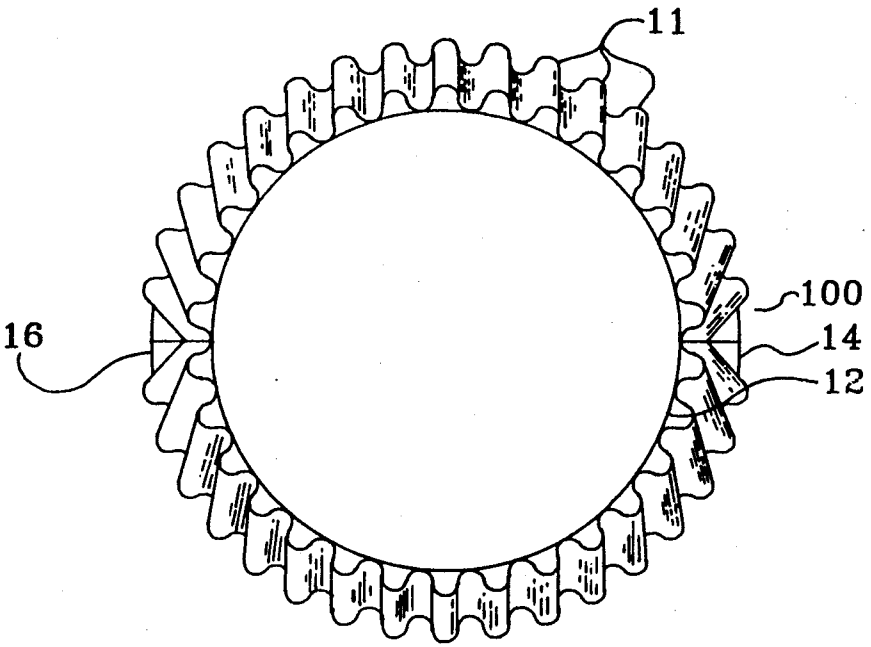
FIG. 2: is a bottom planar view of the preferred beverage container holder of FIG. 1.
Figure 1:
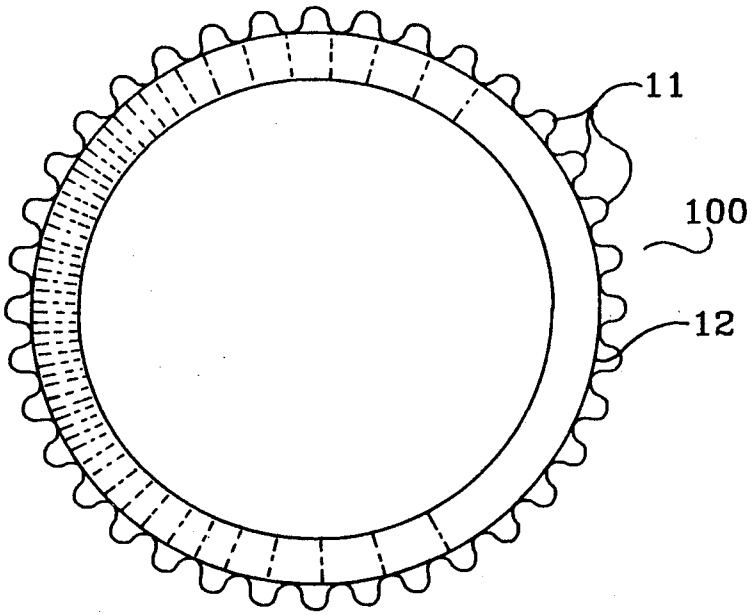
FIG. 1: is a top planar view of a preferred beverage container holder of this invention.
Figure 3:
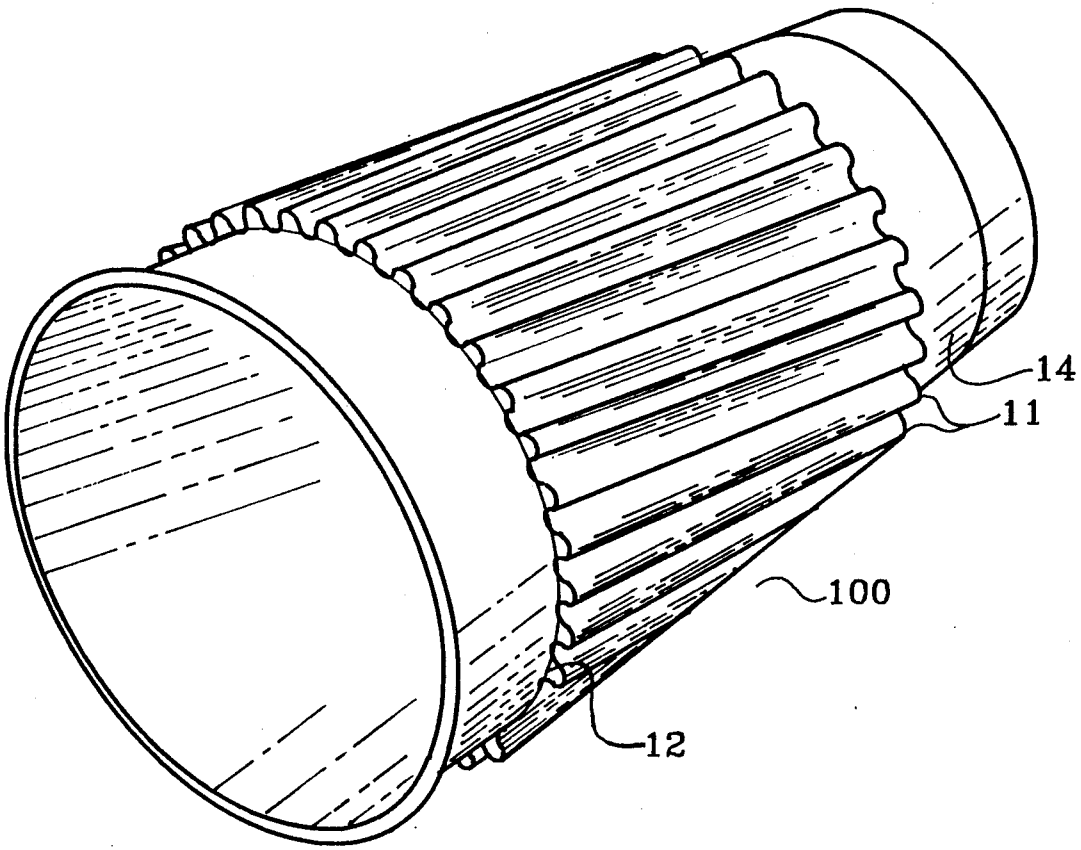
FIG. 3: is a perspective view of the preferred beverage container holder of FIG. 1 disposed around a paper cup.
Figure 4:
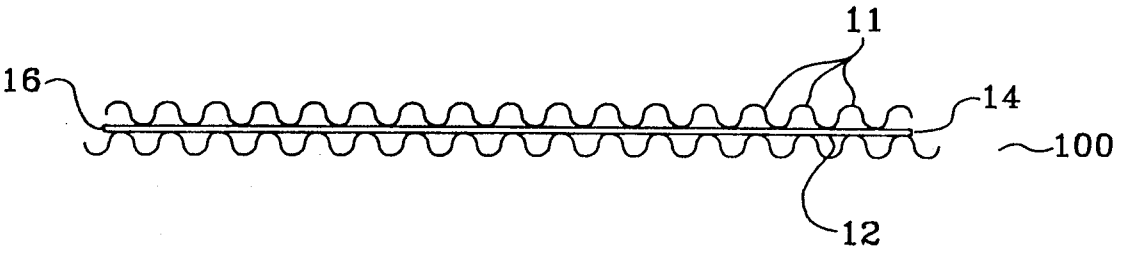
FIG. 4: is a top view of the preferred beverage container holder of FIG. 1 in a collapsed and flattened condition.
Figure 5:
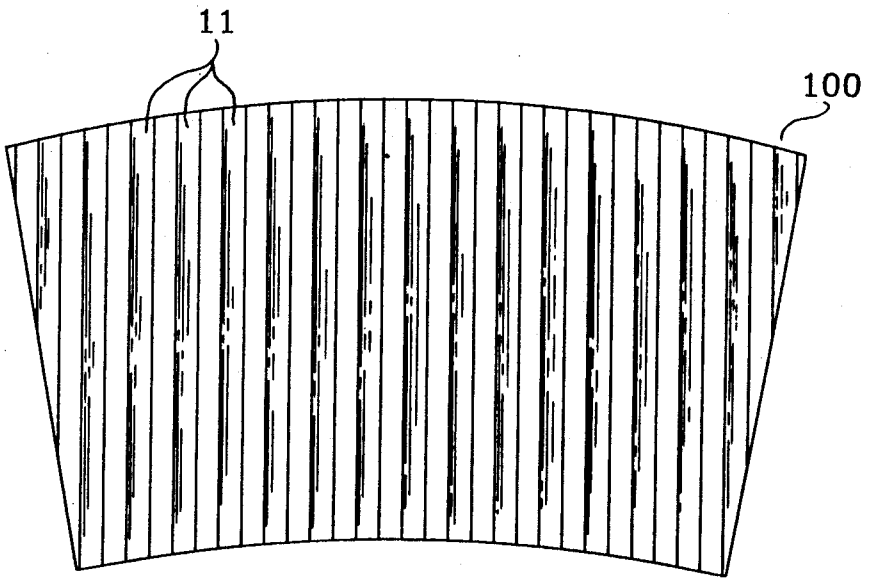
FIG. 5: is a side view of the flattened beverage container holder of FIG. 4.
Figure 6B:
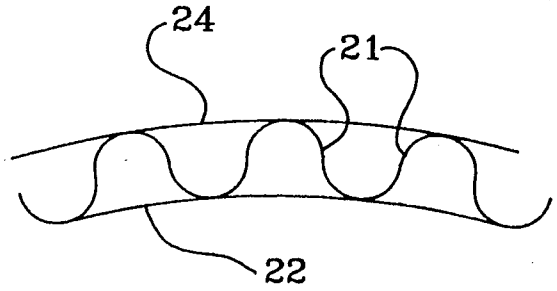
Figure 6A:
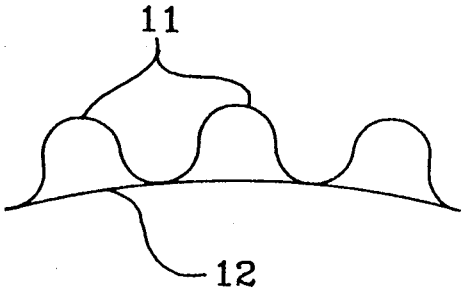
Figure 7B:
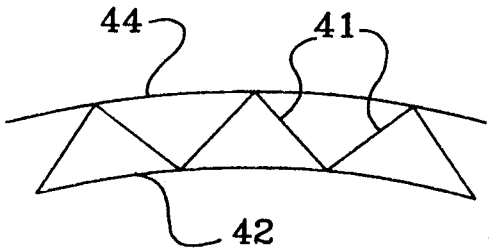
Figure 7A:
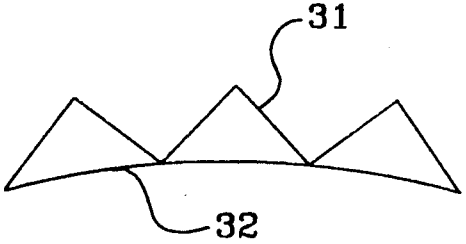

This invention provides corrugated beverage container holders and beverage containers which are environmentally friendly and which provide adequate insulation properties approaching those of polystyrene. The corrugated tubes of these products preferably contain longitudinally extending flutes and include a generally tapered or conical structure, typical of beverage containers. The corrugation can be made of cellulosic materials, including craft paper, sulfite paper, or recycled paper. Ideally, the fluting and liners of this invention are adhered to one another with a recyclable, and preferably, a biodegradable adhesive, for example, R130 adhesive by Fasson Inc., Grand Rapids, MI.

With reference to FIGS. 1–5, there is shown, in multiple views, a preferred beverage container holder 100 of this invention. The preferred holder 100 includes a tubular structure having an inner liner 12 and sinuous fluting 11 disposed around the periphery of the liner 12.

The preferred material of this invention, corrugated cardboard, is generally available in rather large widths of about 5 to 7 feet. The corrugated medium, a web of paperboard, or more preferably, virgin kraft or similar easily recycled cellulosic material, is heated and moistened by a steam shower and then fluted by passing it between a pair of rollers. After fluting, the tips of the fluting 11 are glued, preferably employing a recyclable, and more preferably employing a biodegradable adhesive, to the inner liner 12, such as a single face of paperboard or kraft. At least the surface of the liner that is intended to contact the beverage container is desirably treated with a water-resisting or water-proofing agent, such as wax or silicone, for minimizing the absorption of condensation and other liquids into the cellulosic material.

The above-described method produces a single face sheet of corrugated cardboard. The cardboard is then folded flat, or scored, along its inner liner 12 and cut into an arcuate shape, such as that depicted in FIGS. 4 and 5. The arcuate shape, which is preferably concave at the top and convex at the bottom, permits the holder 100 to be opened into a generally conical configuration, shown in FIGS. 1–3.

Depending upon the location of the fold line, one or both of the longitudinal sides of the flattened and cut corrugation material are adhered so as to form a tube when the structure is opened. Preferably, the inner liner 12 is adhered or scored to form at least two longitudinally folding axes 14 and 16, which are preferably located 180° apart on the resulting circumference of the open tube. These axes 14 and 16 do not interfere with either the radial expansion or the resulting conical shape formed by the tube.

Alternatively, the fluting of this invention can comprise angular fluting 31 adhesively attached to an inner liner 32, such as that described in FIG. *7a*. Alternative constructions for the corrugated structures of this invention can include circular, square, or rectangular fluting, all of which contain insulating air. This fluting can be sealed at one or both ends to provide more containment of the air, or left open to permit the air to flow through as it is heated or cooled by the contents of the beverage container. Finally, the shape of the corrugated "tubular member" of this invention can be round, square, rectangular, star-shaped, or any other desirable configuration.

Double-faced corrugation, such as that described in FIGS. *6b* and *7b*, can also be employed. Such corrugation is typically found in cardboard boxes, and includes an outer liner 24 or 44 in addition to an inner liner 22 and 42. The liners preferably are constructed with paperboard or kraft and are adhered to the tips of the flutes 21 and 41 on opposite contacting points. The corrugated board is thereafter preferably coated with a water-proofing agent, cut, scored, and adhesively joined to provide a similar construction as described above for the single face sheet.

The normal direction of the flutes of the corrugated materials of this invention is vertical from the top to the bottom of the holder or container, but it is expected that the flutes can be disposed horizontally, or in a direction which is oblique to the central axis of the cup or expanded holder.

The air space created by the combination of the flute and liner is an important element for furnishing the insulating holder and cups of this invention. The substantially contained air in these flutes is an extremely effective insulator and will keep the handling contact surface far below the temperature of the hot or cold beverage contained in the cup or container.

Figure 9:
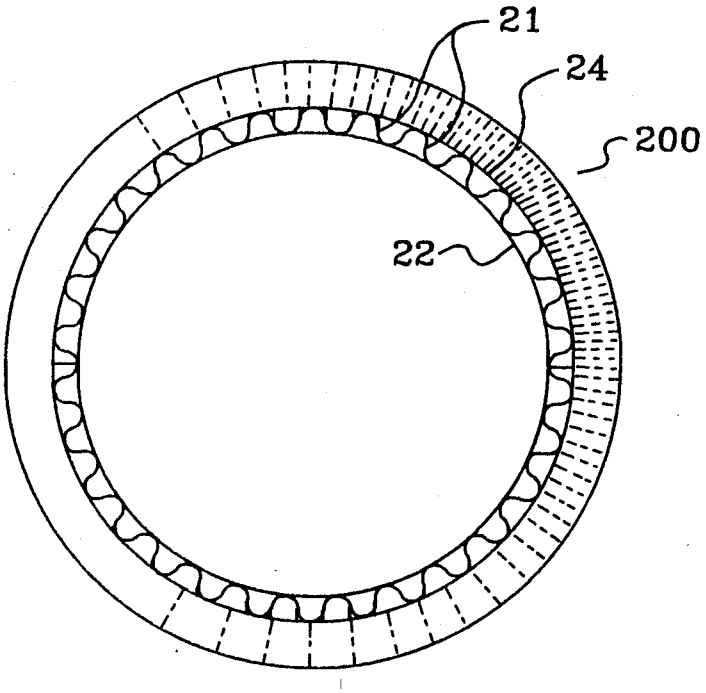
FIG. 9: illustrates a planar bottom view of the preferred hot beverage container holder of FIG. 8.
Figure 8:
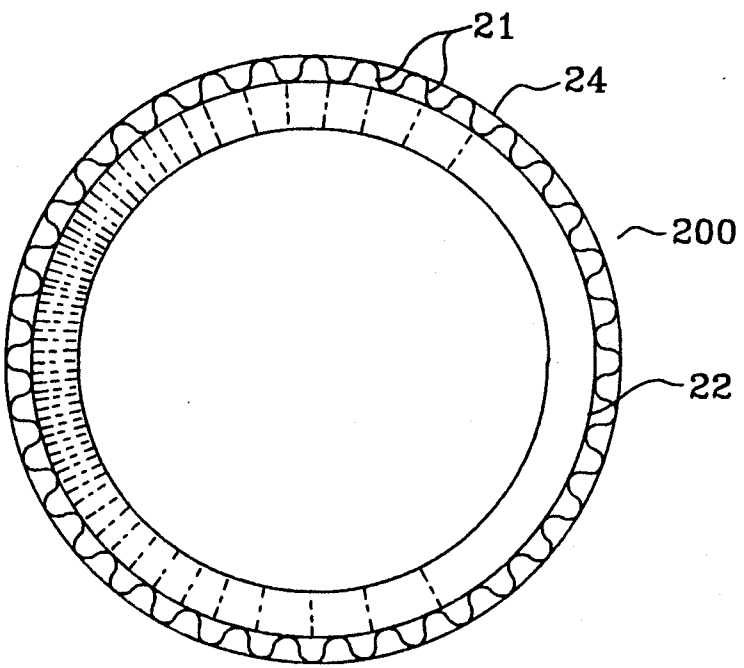
FIG. 8: is a top planar view of a preferred beverage container holder having an inner and outer liner.
Figure 10:
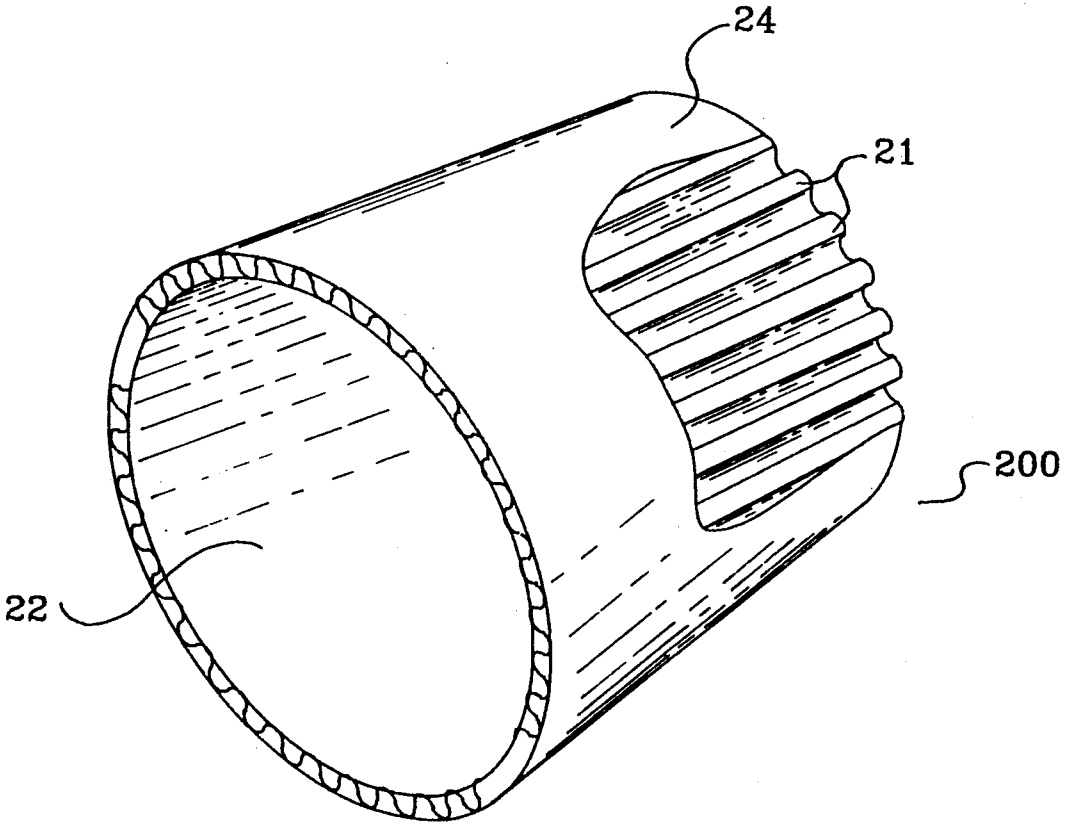
FIG. 10: is a perspective view of the preferred beverage container holder of FIG. 8 illustrating internal flute portions in break-away views.

A preferred double-sided corrugated beverage container holder 200 is described in FIGS. 8–10. This holder 200 includes outer liner member 24 adhesively disposed at the contact points of flute 21 as substantially earlier described in FIG. *6b*. This embodiment promotes a smoother, more aesthetically appealing exterior which facilitates printing of advertising logos, slogans, and the like. This embodiment has all of the features associated with holder 100, including the optional ability to be collapsed at two or more points along its radial surface, to form a flat structure, similar to that disclosed in FIG. 5.

Figure 12:
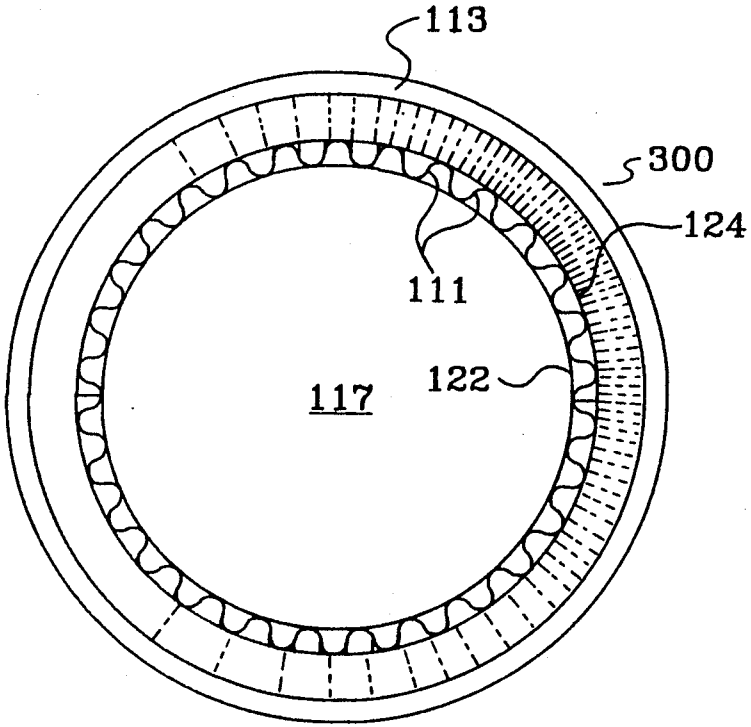
FIG. 12: is a bottom planar view of the preferred corrugated beverage container of FIG. 11.
Figure 11:
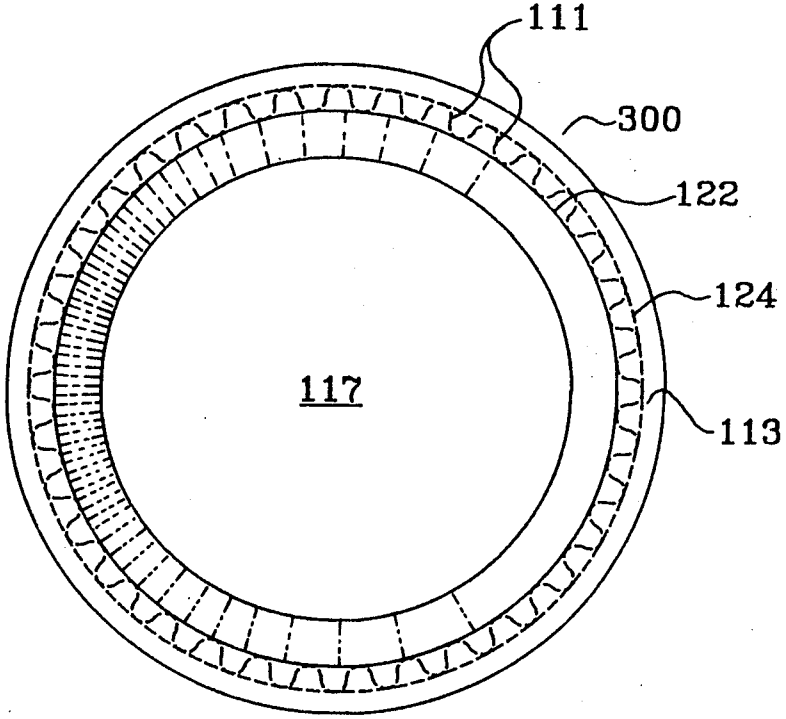
FIG. 11: is a top planar view of the preferred corrugated beverage container.
Figure 13:
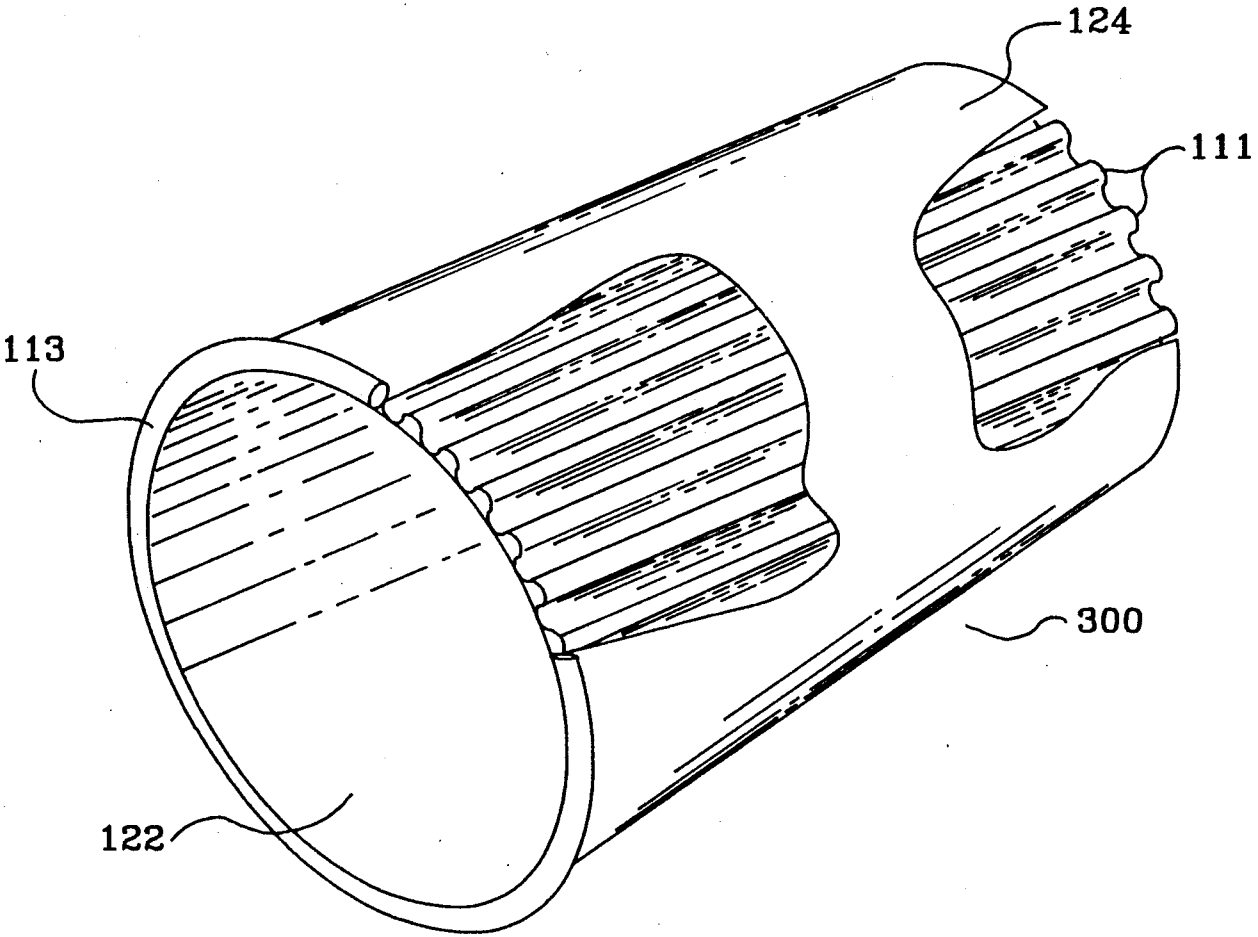
FIG. 13: is a perspective view of the preferred corrugated beverage container of FIG. 11 illustrating internal flute portions in break-away views.

While this discussion has primarily focused upon the application of this invention to beverage container holders, a further preferred embodiment is described in FIGS. 11–13, which illustrate a corrugated container or cup. The corrugated beverage container 300 contains a drinking lip 113, fluting 111, inner liner 122, and an optional exterior liner 124. Preferably, the inner liner 122 is coated with a water-resisting or water-proof agent at least on the surface that is to be exposed to a beverage, as disclosed earlier. The construction techniques known in the industry for making paper cups can be readily adapted to the preferred materials of this invention for manufacturing the preferred corrugated beverage container 300.

Although the fluting is described as continuing through the bottom of the container 300, it is equally understood that the sealed bottom 117 can be fabricated in the usual manner with a solid waxed paper rim (not shown) in which no fluting is apparent. All that is required to provided a comfortable exterior surface temperature is to dispose the fluting along the exterior cup portions in a manner such that the user's fingers come in contact with an area insulated by the fluting.

It is further expected that the fluting of holder 100 could be reversed so that it is located on the inside of the holder and the liner 12 is located on the exterior of the holder. In such a variation, printing could be more readily provided on the smooth liner 12. In further embodiments of this invention, it is expected that waterproof polyethylene coatings could be used in place of the silicone and wax compositions disclosed above. The industrial application of polyethylene coatings is readily available to known artisans. Finally, although the fluting structure is disclosed as being substantially parallel, a fluting structure which permits the individual flutes to taper to an imaginary vanishing point would also be within the concept of this invention.

From the foregoing, it can be realized that this invention provides improved means for containing hot and cold liquids, which are relatively safe for the environment and which can be produced inexpensively. The corrugated beverage containers and holders of this invention are readily fabricated with existing paper-making equipment, and present adequate solutions to the waste disposal problem associated with polystyrene and the uncomfortable handling normally associated with wax-covered paper cups. Although various embodiments have been illustrated, this was for the purpose of describing, but not limiting, the invention. Various modifications, which will become apparent to one skilled in the art, are within the scope of this invention described in the attached claims.

What is claimed is:

1. A recyclable, insulating beverage container holder, comprising a corrugated tubular member comprising cellulosic material and at least a first opening therein for receiving and retaining a beverage container, said corrugated tubular member comprising fluting means for containing insulating air; said fluting means comprising fluting adhesively attached to a liner with a recyclable adhesive.

2. The holder of claim 1, wherein said tubular member comprises a corrugated tube having first and second open ends of unequal cross-sectional dimensions.

3. The holder of claim 1, wherein said first and second openings are circular, and said fluting extends between said first and second openings.

4. The holder of claim 1, wherein said tubular member comprises at least two pivot axes for permitting said tubular member to fold into a flattened condition.

5. The holder of claim 1, wherein a surface of said liner is coated with a water-resisting agent.

6. The holder of claim 1, wherein said fluting comprises sinuous fluting.

7. The holder of claim 1, wherein said tubular member comprises a convex shape along a top edge portion and a concave shape along a bottom edge portion when disposed in said flattened condition.

8. A recyclable collapsible beverage container holder comprising a corrugated tube 9. The holder of claim 8, wherein said flattened structure comprises a convex shape along a top edge portion and a concave shape along a bottom edge portion comprising recyclable cellulosic material, said tube including a liner adhesively attached with a recyclable adhesive to fluting for containing insulating air, said tube collapsible about two pivot axes so as to form a flattened structure.

10. An insulating beverage container, comprising a cellulosic corrugated tubular member consisting essentially of recyclable material, said container including a first opening and an internal cavity for containing a hot or cold medium, said container including fluting means adhesively attached with a recyclable adhesive to a liner for containing insulating air.

11. The container of claim 10, wherein said liner comprises a water-resisting agent applied to at least a surface of said liner which is to be exposed to said beverage.

12. The container of claim 10, further comprising a smooth drinking lip disposed along a periphery of said first opening.

13. The container of claim 12, wherein said fluting means comprises a sinuous cross-section disposed on said liner.

14. A method for manufacturing a recyclable corrugated beverage container holder, comprising: providing a recyclable, corrugated, cellulosic material comprising fluting means adhesively attached with a recyclable or biodegradable adhesive to a liner for containing insulating air, cutting said corrugated material into an elongated strip, and configuring said elongated strip to form a tubular member having a pair of folding axes; said tubular member collapsible about said axes to form a flattened structure.

15. A biodegradable, insulating beverage container, comprising a corrugated tubular member containing a biodegradable, cellulosic liner and fluting, said tubular member having an internal water-resistant cavity therein for receiving a hot or cold medium, said fluting adhered to said liner with a biodegradable adhesive to provide means for containing insulating air.

16. The container of claim 15 further comprising a smooth drinking lip.

17. The container of claim 15, wherein said fluting comprises a sinuous cross-section.

18. A biodegradable insulating beverage container holder, comprising a corrugated tubular member containing a biodegradable, cellulosic liner and fluting, said tubular member comprising an internal cavity therein for receiving and retaining a beverage container, said fluting adhered to said liner with a biodegradable adhesive to provide means for containing insulating air.

* * * * *

UNITED STATES PATENT AND TRADEMARK OFFICE

CERTIFICATE OF CORRECTION

PATENT NO. : 5,205,473
APPLICATION NO. : 07/854425
DATED : April 27, 1993
INVENTOR(S) : David W. Coffin, Sr.

It is certified that error appears in the above-identified patent and that said Letters Patent is hereby corrected as shown below:

On the Title Page

In line 1, under "ABSTRACT", before "which" insert --provided--.

In the Claims

In column 5, line 21, delete "tube." and insert --tube comprising recyclable cellulosic material, said tube including a liner adhesively attached with a recyclable adhesive to fluting for containing insulating air, said tube collapsible about two pivot axes so as to form a flattened structure.--

In column 5, lines 24-29, delete "bottom edge portion comprising recyclable cellulosic material, said tube including a liner adhesively attached with a recyclable adhesive to fluting for containing insulating air, said tube collapsible about two pivot axes so as to form a flattened structure." and substitute --bottom edge portion.-- in its place.

Signed and Sealed this

Fifth Day of June, 2007

JON W. DUDAS
*Director of the United States Patent and Trademark Office*